US007178172B2

(12) United States Patent
Laing

(10) Patent No.: US 7,178,172 B2
(45) Date of Patent: Feb. 20, 2007

(54) HAT WITH DETACHABLE HAIR SECURING STRAP

(76) Inventor: Margaret Patricia Laing, 6195 Mimosa Cir., Tucker, GA (US) 30084

( * ) Notice: Subject to any disclaimer, the term of this patent is extended or adjusted under 35 U.S.C. 154(b) by 0 days.

(21) Appl. No.: 11/024,135

(22) Filed: Dec. 28, 2004

(65) Prior Publication Data

US 2006/0137074 A1 Jun. 29, 2006

(51) Int. Cl.
*A42B 1/24* (2006.01)

(52) U.S. Cl. ..... 2/209.13; 2/174; 132/273

(58) Field of Classification Search ..... 2/209.13, 2/174, 202, 206, 207, 209.3, 918, 195.2, 2/183; 132/273, 275; D2/865, 866, 872–874, D2/876, 881, 877
See application file for complete search history.

(56) References Cited

U.S. PATENT DOCUMENTS

| | | | | |
|---|---|---|---|---|
| 2,685,091 | A * | 8/1954 | Thill | 2/204 |
| 5,170,509 | A * | 12/1992 | Leopold | 2/195.1 |
| 5,239,705 | A * | 8/1993 | Leopold | 2/209.13 |
| D405,590 | S | 2/1999 | Bartz | |
| 6,421,838 | B1 | 7/2002 | Frank | |
| 6,688,316 | B1 * | 2/2004 | Klug | 132/286 |

* cited by examiner

*Primary Examiner*—Katherine Moran
(74) *Attorney, Agent, or Firm*—Ashish D. Patel, Esq.; Myers & Kaplan, LLC; Joel D. Myers, Esq.

(57) ABSTRACT

A hat with a detachable, elasticized hair securing strap, wherein the securing strap is removably secured to the hat via conventional hook-and-loop fasteners, thereby enabling convenient replacement of the securing strap either upon diminished elasticity of same, and/or with a decoratively-adorned detachable hair securing strap.

9 Claims, 2 Drawing Sheets

HAT WITH DETACHABLE HAIR SECURING STRAP

TECHNICAL FIELD

The present invention relates generally to headwear, and more specifically to a hat with a detachable, elasticized hair securing strap, wherein use of the present invention negates or nullifies the need for application of separate hair bands or accessories to secure the hat wearer's hair in the form of a "ponytail" hairstyle, and further facilitates replacement of the detachable hair securing strap upon diminished elasticity of same.

BACKGROUND OF THE INVENTION

Headwear is a popular and convenient form of apparel amongst men, women and children alike. However, many hat wearers, and in particular, those who adorn traditional "baseball" caps, must often first fashion or style their hair so as to facilitate comfortable wear of the selected hat. That is, individuals having relatively lengthy hair often first pull or place their hair back into a "ponytail" hairstyle via application of conventional elasticized hair bands, and, thereafter, bring the formed ponytail through the rear aperture formed in the traditional baseball cap. Unfortunately, and as is all too often the case, the hair band creates a bulge of hair that obstructs proper wear or full recession of the wearer's head into the crown of hat; thus, resulting in an overall uncomfortable and aesthetically unappealing head covering.

Accordingly, in an attempt to resolve the disadvantages associated with the foregoing methods of hat and hair wear, hats comprising integrally formed elastic straps and/or hair "scrunchies", disposed on the rear portions thereof, are currently available. However, such products are inherently structurally deficient as frequent use of same unavoidably results in degradation or diminishment of the overall elastic resiliency of the hair strap or scrunchie; thus, impeding long-term use of the product, and leaving the consumer with an ineffective, inoperable and unsightly distended or grossly stretched hair strap or scrunchie. Indeed, the consumer's only recourse is to purchase another of the same product, or reluctantly revert back to the above-described methods of hat and hair wear.

Therefore, it is readily apparent that there is a need for a hat with a detachable, elasticized hair securing strap, wherein use of the present invention enables full and comfortable positioning and recession of the wearer's head within the crown of the hat, and further enables the wearer to selectively replace the detachable hair securing strap upon diminished elasticity of same.

BRIEF SUMMARY OF THE INVENTION

Briefly described, in a preferred embodiment, the present invention overcomes the above-mentioned disadvantage, and meets the recognized need for such a device by providing a hat with a detachable, elasticized hair securing strap, wherein the securing strap is removably secured to the hat via conventional hook-and-loop fasteners, thereby enabling convenient replacement of the securing strap either upon diminished elasticity of same, and/or with a decoratively-adorned detachable hair securing strap.

According to its major aspects and broadly stated, the present invention in its preferred form is a hat with a detachable hair securing strap, generally comprising a hat, and a detachable hair securing strap.

More specifically, the present invention is a hat with a detachable hair securing strap, wherein the conventional rearwardly-disposed securing strap of a traditional baseball-style cap is replaced with a detachable, elasticized hair securing strap removably secured via hook-and-loop fastener (e.g., VELCRO) to the perimeter of the hat's rear aperture. The detachable hair securing strap of the present invention preferably enables convenient replacement of the securing strap upon diminished elasticity of same, and/or further enables selective replacement of the relatively simple cloth or fabric-covered elastic securing strap with a differently colored or otherwise decoratively-adorned detachable hair securing strap.

Accordingly, a feature and advantage of the present invention is its ability to provide a hat with a detachable, replaceable, and/or interchangeable hair securing strap.

Another feature and advantage of the present invention is its ability to provide an elasticized hair securing strap removably secured to a hat via conventional hook-and-loop fasteners, thereby enabling convenient replacement of the securing strap upon diminished elasticity of same.

Still another feature and advantage of the present invention is its ability to enable frequent and long-term use of the product.

Yet another feature and advantage of the present invention is its ability to be incorporated into any selected headwear.

Still yet another feature and advantage of the present invention is its ability to negate or nullify the need for application of separate hair bands or accessories to secure the hat wearer's hair in the form of a "ponytail" hairstyle.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
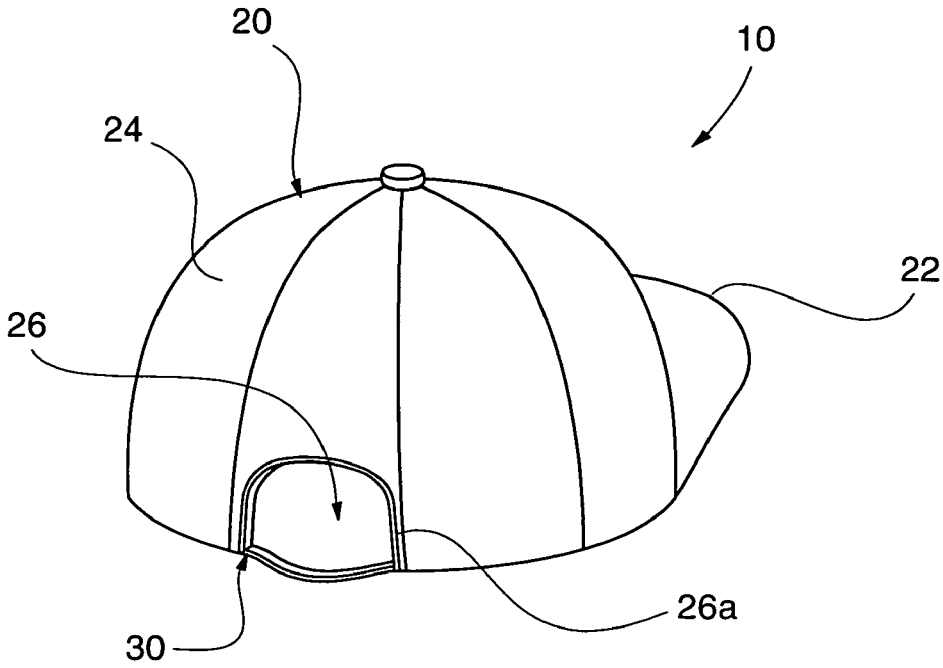
FIG. 1 is a perspective view of a hat with detachable hair securing strap according to a preferred embodiment of the present invention.
Figure 2:
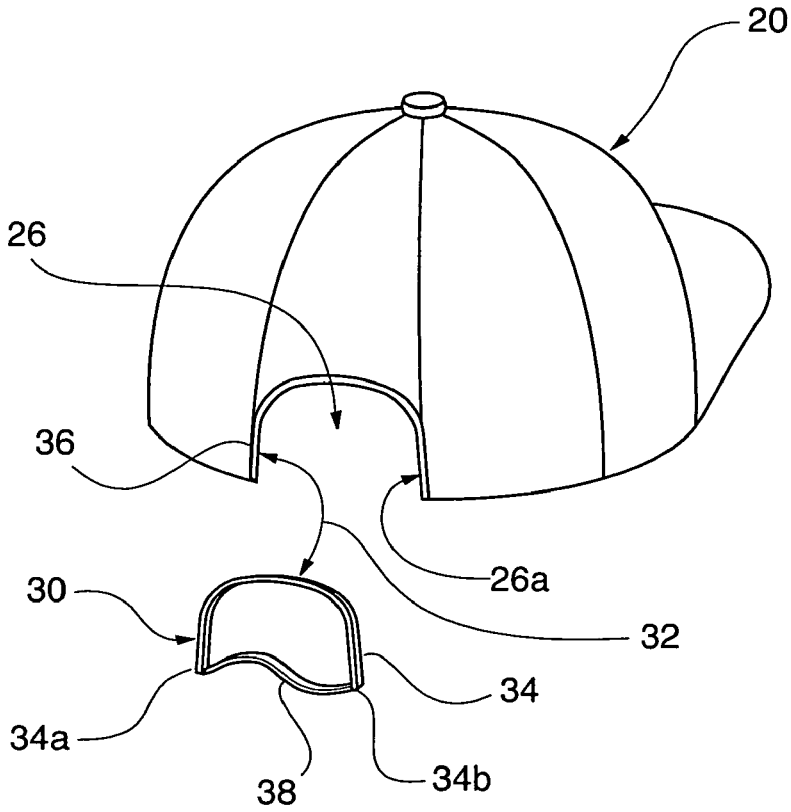
FIG. 2 is a perspective view of a hat with detachable hair securing strap according to a preferred embodiment of the present invention; and, FIG. 3 is a perspective view of a hat with detachable hair securing strap according to a preferred embodiment of the present invention, shown in use.
Figure 3:
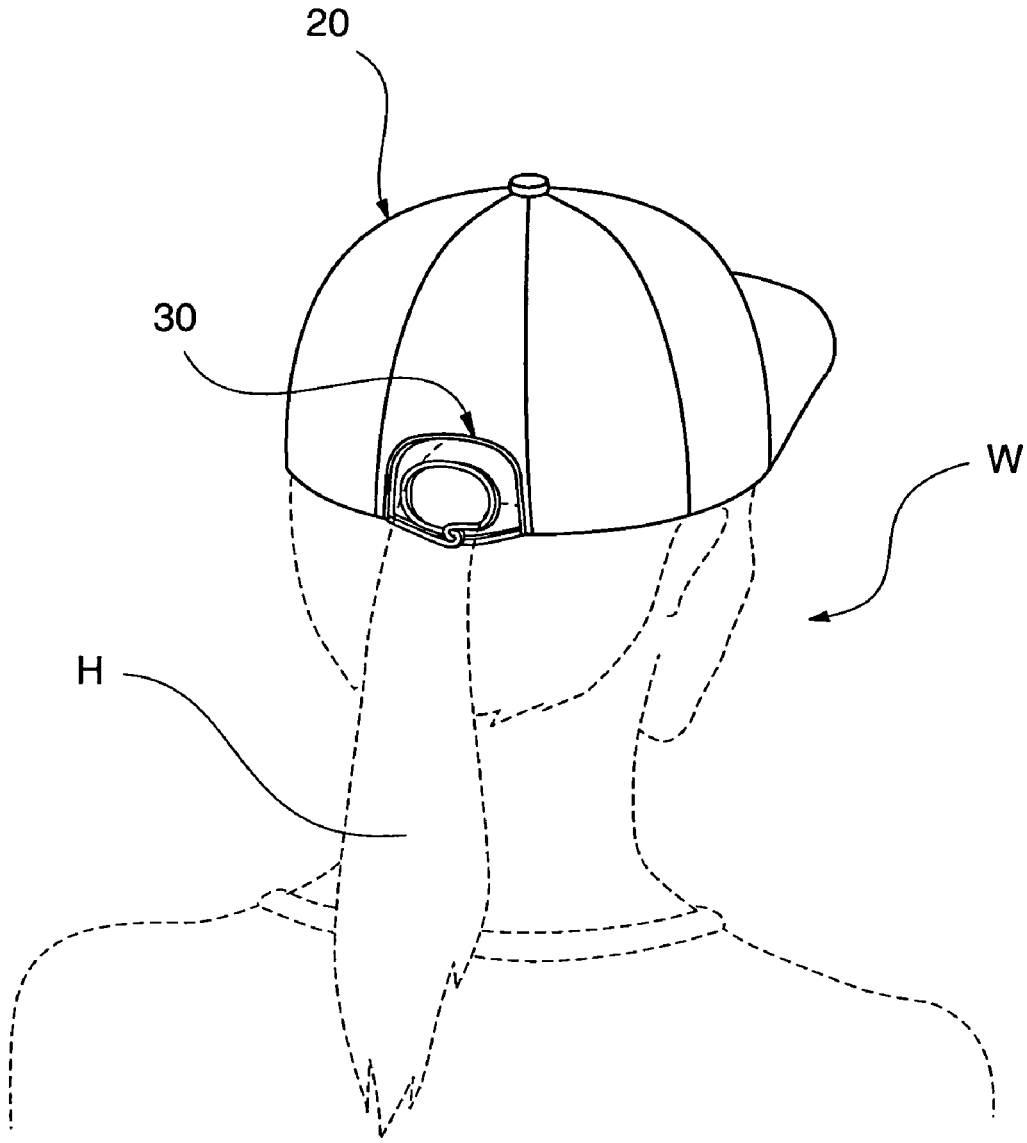

In describing the preferred and alternate embodiments of the present invention, as illustrated in FIGS. 1–3, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1–3, the present invention in its preferred embodiment is, generally, a hat with detachable hair securing strap 10, comprising hat 20 and detachable hair securing strap 30. Hat 20 preferably comprises brim 22, crown 24, and rear aperture 26 formed through crown 24. Although FIGS. 1–3 depict hat 20 as a traditional baseball-style hat, it should be recognized that hat 20 may be any suitable headwear or headgear that may functionally benefit from incorporation of detachable hair securing strap 30 and the method of hair tying or securing attendant thereto.

Referring now more specifically to FIG. 2, detachable hair securing strap 30 preferably comprises hook portion 34 of conventional hook-and-loop fastener assembly 32, wherein hook portion 34 is preferably strap-like and suitably shaped and dimensioned so as to be precisely received and engaged to loop portion 36 of conventional hook-and-loop fastener assembly 32, preferably integrally formed or otherwise stitched around perimeter 26*a* of aperture 26.

Preferably secured and extending between terminal ends 34*a*, 34*b* of hook portion 34 is cloth or fabric-covered elastic hair band or strap 38, wherein elastic hair strap 38 may be stretched and twisted around the wearer's bundled hair so as to secure same in a ponytail hairstyle, as more fully described below. Although the foregoing description contemplates that hook portion 34 be coupled to elastic hair strap 38, it should be recognized that hook portion 34 could be integrally formed or otherwise stitched around perimeter 26*a* of aperture 26, wherein loop portion 36 would then naturally be coupled to elastic hair strap 38. It should be further recognized that hook-and-loop fastener assembly 32 could be replaced with peg-and-slot assemblies/straps, snap-button assemblies/straps, rib-and-groove assemblies/straps, zipper assemblies/straps, ridge-and-channel assemblies/straps, or the like, wherein elastic hair straps 38 could be suitable affixed thereto.

Accordingly, in use, and as best illustrated in FIG. 3, wearer W preferably places hat 20 atop his/her head, wherein at least a portion of wearer's W hair H is preferably brought through aperture 26 of hat 20. Thereafter, elastic hair strap 38 is preferably stretched and twisted around the portion of hair H extending through aperture 26, and suitably brought into a ponytail hairstyle. Alternatively, detachable hair securing strap 30 may be first entirely removed from hat 20, and elastic hair strap 38 utilized to bring wearer's W hair H into a ponytail hairstyle, wherein hook portion 34 of detachable hair securing strap 30 could thereafter be re-engaged to loop portion 36 disposed on hat 20. It should be recognized that elastic hair strap 38 may be utilized to bring wearer's W hair H into hairstyles other than a ponytail.

Preferably, upon diminished elasticity of elastic hair strap 38 of detachable hair securing strap 30, wearer W preferably conveniently removes or disengages hook portion 34 from loop portion 36 on hat 20, wherein a replacement detachable hair securing strap 30 is preferably re-engaged thereto; thus, enabling long-term use of hat 20. Alternatively, because detachable hair securing strap 30 comprises relatively simple cloth or fabric-covered elastic hair strap 38, wearer W may elect to replace such a detachable hair securing strap 30 with a differently colored or otherwise decoratively-adorned or more ornate detachable hair securing strap 30; thereby, enabling personalization of hat 20.

It is contemplated in an alternate embodiment that hat 20 may be manufactured with more than one aperture 26, wherein more than one detachable hair securing strap 30 could accordingly be removably secured thereto; thus, facilitating dual ponytails or other hairstyles having multiple bound locks of hair.

It is contemplated in another alternate embodiment that detachable hair securing strap 30, and more specifically, elastic hair strap 38, could be replaced by other suitable hair tying or binding accessories removably securable to hat 20, such as, for exemplary purposes only, hair loops, hair ties, bungee bands, scrunchies, scarves, head bands, hair slides, adjustable bands, and/or the like.

It is contemplated in still another alternate embodiment that detachable hair securing strap 30 could be removably securable to any portion, either exteriorly or interiorly, of crown 24 of hat 20.

It is contemplated in yet another alternate embodiment that elastic hair strap 38 may be replaced with other suitable flexible, stretchable and resilient materials.

It is contemplated in still yet another alternate embodiment that elastic hair strap 38 may be replaced with full or complete elastic band.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A hair securing apparatus, comprising:

a piece of headwear having an open loop aperture being generally defined by a C-shape perimeter; and, a removable hair securing means removably secured within said perimeter, wherein said hair securing means comprises a first portion of a hook-and-loop fastener assembly, said first portion removably securable to a second portion of said hook-and-loop fastener assembly, said second portion integrally formed or otherwise stitched to said aperture of said headwear along said C-shape perimeter, and wherein said first portion is coupled to an elastic strap closing said open loop aperture, said elastic strap stretchable and twistable around a portion of hair for securing the portion of hair thereby forming a smaller closed loop around the portion of hair within said C-shape perimeter.

2. The apparatus of claim 1, wherein said headwear is a hat.

3. The apparatus of claim 1, wherein said elastic strap is selected from the group consisting of elastic hair straps, elastic hair bands, hair loops, hair ties, bungee bands, scrunchies, scarves, head bands, adjustable bands, and combinations thereof.

4. A hair securing apparatus, comprising:

a hat having an open-loop aperture; and, a detachable closed-loop hair securing strap, said detachable hair securing strap removably secured to said open-loop aperture, thereby closing said open-loop aperture, wherein said detachable hair securing strap is removably secured to at least a portion of a C-shape perimeter defining said aperture, and wherein said detachable closed-loop hair securing strap comprises a first C-shape fastening portion, said first fastening portion removably securable to a second C-shape fastening portion carried by said C-shape perimeter defining said aperture of said hat, and wherein said first fastening portion is coupled to a flexible, stretchable and resilient strap, said strap stretchable and twistable around a portion of hair for securing the portion of hair, thereby securing the portion of hair within a second closed loop positioned within said closed loop.

5. The apparatus of claim 4, wherein said first fastening portion and said second fastening portion of said detachable hair securing strap is selected from the group consisting of hook-and-loop fasteners, peg-and-slot assemblies/straps, snap-button assemblies/straps, rib-and-groove assemblies/straps, zipper assemblies/straps, ridge-and-channel assemblies/straps, and wherein said strap is selected from the group consisting of elastic hair straps, elastic hair bands, hair loops, hair ties, bungee bands, scrunchies, scarves, head bands, adjustable bands, and combinations thereof.

6. A detachable hair securing apparatus adapted to be removably secured to a piece of headwear, said detachable hair securing apparatus comprising:

a first fastening portion, said first fastening portion removably securable to a second fastening portion, said second fastening portion positioned along a C-shape aperture on the headwear; and, a hair securing means, wherein said first fastening portion is coupled to a portion of an outer perimeter of said hair securing means, wherein said hair securing means is stretchable and twistable around a portion of hair for securing the portion of hair, within a small loop formed within a larger loop secured within said C-shape aperture.

7. The apparatus of claim 6, wherein said first fastening portion is selected from the group consisting of hook-and-loop fasteners, peg-and-slot assemblies/straps, snap-button assemblies/straps, rib-and-groove assemblies/straps, zipper assemblies/straps, ridge-and-channel assemblies/straps, and combinations thereof.

8. The apparatus of claim 6, wherein said second fastening portion is selected from the group consisting of hook-and-loop fasteners, peg-and-slot assemblies/straps, snap-button assemblies/straps, rib-and-groove assemblies/straps, zipper assemblies/straps, ridge-and-channel assemblies/straps, and combinations thereof.

9. The apparatus of claim 6 wherein said hair securing means is selected from the group consisting of elastic hair straps, elastic hair bands, hair loops, hair ties, bungee bands, scrunchies, scarves, head bands, adjustable bands, and combinations thereof.

* * * * *